US011639535B2

(12) United States Patent
Jung

(10) Patent No.: US 11,639,535 B2
(45) Date of Patent: May 2, 2023

(54) STEEL MATERIAL FOR WELDED STEEL PIPE, HAVING EXCELLENT LONGITUDINAL UNIFORM ELONGATION, MANUFACTURING METHOD THEREFOR, AND STEEL PIPE USING SAME

(71) Applicant: POSCO, Pohang-si (KR)

(72) Inventor: Hwan-Gyo Jung, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 317 days.

(21) Appl. No.: 16/472,556

(22) PCT Filed: Dec. 7, 2017

(86) PCT No.: PCT/KR2017/014286
§ 371 (c)(1),
(2) Date: Jun. 21, 2019

(87) PCT Pub. No.: WO2018/117497
PCT Pub. Date: Jun. 28, 2018

(65) Prior Publication Data

US 2019/0316218 A1 Oct. 17, 2019

(30) Foreign Application Priority Data

Dec. 23, 2016 (KR) ..... 10-2016-0177645

(51) Int. Cl.
*C21D 8/02* (2006.01)
*C21D 9/08* (2006.01)
(Continued)

(52) U.S. Cl.
CPC ..... *C21D 8/02* (2013.01); *C21D 9/08* (2013.01); *C21D 9/46* (2013.01); *C22C 38/02* (2013.01);
(Continued)

(58) Field of Classification Search
CPC .... C21D 8/02; C21D 9/08; C21D 9/46; C22C 38/02; C22C 38/06; C22C 38/12; C22C 38/14; C22C 38/16; C22C 38/48
See application file for complete search history.

(56) References Cited

U.S. PATENT DOCUMENTS

2016/0222480 A1 8/2016 Hamatani et al.
2017/0022590 A1 1/2017 Yasuda et al.
2018/0073094 A1 3/2018 Bai et al.

FOREIGN PATENT DOCUMENTS

CN 103249854 A 8/2013
CN 104789863 A 7/2015
(Continued)

OTHER PUBLICATIONS

KR1020130073472 English (Year: 2021).*
Chinese Office Action dated Aug. 26, 2020 issued in Chinese Patent Application No. 201780079896.9 (with English translation).

*Primary Examiner* — Robert S Jones, Jr.
*Assistant Examiner* — Jiangtian Xu
(74) *Attorney, Agent, or Firm* — Morgan, Lewis & Bockius LLP

(57) ABSTRACT

The present invention relates to a steel material used for a line pipe for transporting crude oil or natural gas and the like and, more specifically, to a steel material for a welded steel pipe, having excellent longitudinal uniform elongation for the pipe, a manufacturing method therefor, and a steel pipe using the same.

6 Claims, 1 Drawing Sheet

INVENTIVE EXAMPLE 12 INVENTIVE EXAMPLE 13

COMPARATIVE EXAMPLE 6 COMPARATIVE EXAMPLE 12

(51) Int. Cl.

| | |
|---|---|
| ***C21D 9/46*** | (2006.01) |
| ***C22C 38/02*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/48*** | (2006.01) |

(52) U.S. Cl.
CPC ..... *C22C 38/06* (2013.01); *C22C 38/12* (2013.01); *C22C 38/14* (2013.01); *C22C 38/16* (2013.01); *C22C 38/48* (2013.01)

(56) References Cited

FOREIGN PATENT DOCUMENTS

| | | | | |
|---|---|---|---|---|
| CN | 106133175 | A | | 11/2016 |
| EP | 2752499 | A1 | | 7/2014 |
| JP | 2006-291349 | A | | 10/2006 |
| KR | 10-2013-0073472 | A | | 7/2013 |
| KR | 1020130073472 | | * | 7/2013 |
| KR | 10-2013-0114179 | A | | 10/2013 |
| KR | 1020130073472 | | * | 10/2013 |
| KR | 10-1360467 | B1 | | 2/2014 |
| KR | 10-2014-0083540 | A | | 7/2014 |
| KR | 10-2015-0076277 | A | | 7/2015 |
| KR | 10-2016-0048155 | A | | 5/2016 |
| KR | 10-2016-0129875 | A | | 11/2016 |

* cited by examiner

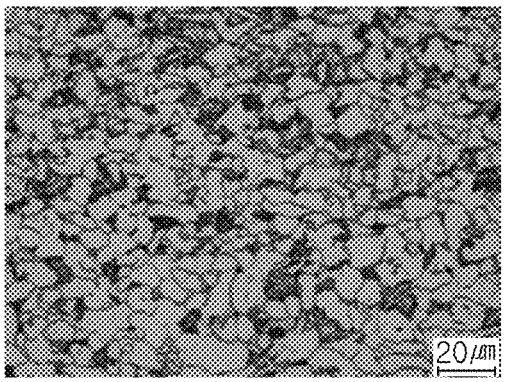
INVENTIVE EXAMPLE 12
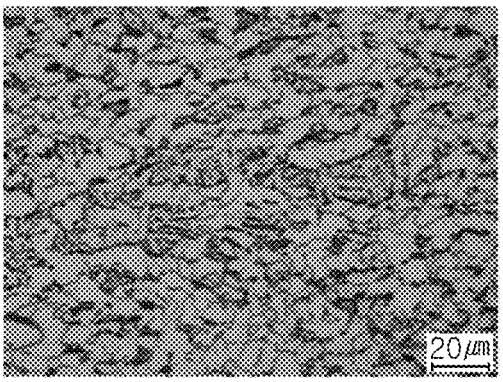
INVENTIVE EXAMPLE 13
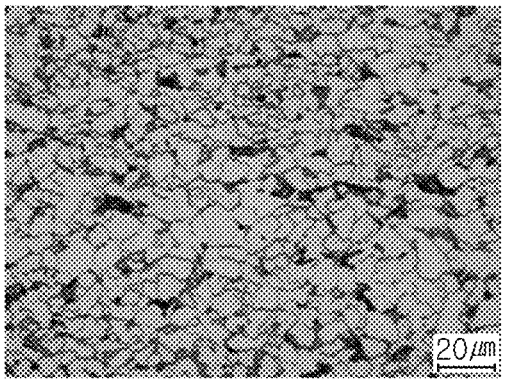
COMPARATIVE EXAMPLE 6
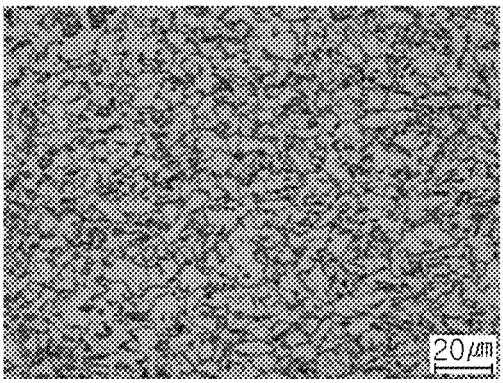
COMPARATIVE EXAMPLE 12

STEEL MATERIAL FOR WELDED STEEL PIPE, HAVING EXCELLENT LONGITUDINAL UNIFORM ELONGATION, MANUFACTURING METHOD THEREFOR, AND STEEL PIPE USING SAME

CROSS REFERENCE

This application is the U.S. National Phase under 35 U.S.C. § 371 of International Application No. PCT/KR2016/014286 filed on Dec. 7, 2016, which claims the benefit of Korean Application No. 10-2016-0177645 filed on Dec. 23, 2016, the entire contents of each are hereby incorporated by reference.

TECHNICAL FIELD

The present disclosure relates to a steel material used for a line pipe for transporting crude oil or natural gas and the like, and more specifically, to a steel material for a welded steel pipe, having excellent longitudinal uniform elongation for the pipe, a manufacturing method therefor, and a steel pipe using the same.

BACKGROUND ART

Recently, line pipes have been constructed in extreme cold regions or areas with frequent ground motion such as regions in which earthquakes frequently occur. Such line pipes are required to have not only usual strength and toughness but also improved deformability. For example, there is an increasing demand for deformability to improve stability of line pipes due to gradual or rapid deformation accompanying the ground motion, load of a structure itself, an earthquake, or the like.

As described above, since deformation of a line pipe, caused by the ground motion, mainly occurs in a length direction of the pipe, deformation characteristics for longitudinal direction of a steel material for manufacturing a pipe are limited to a certain level or higher.

A line pipe, having insufficient deformability, tends to be locally crushed by deformation in a length direction thereof, whereas a line pipe, having improved deformability, may withstand certain deformations without being locally crushed.

In a steel material for a line pipe, deformability is mainly evaluated by uniform elongation. The uniform elongation is a strain before occurrence of necking, in which non-uniform deformation occurs in a tensile test, and has relation to crushing in a pipe caused by non-uniform deformation.

After a steel material for a line pipe is made of a steel pipe, the steel material is coated with epoxy to prevent corrosion. In the epoxy coating process, a heat treatment is performed at a temperature of 180° C. or higher for a certain period of time. In this case, strain aging occurs. Due to such strain aging, an upper yield point is formed to increase yield strength and to decrease uniform elongation.

Accordingly, a steel material fora line pipe, required to have improved deformability, should prevent an upper yield point from occurring due to strain aging and should exhibit high uniform elongation.

On the other hand, deformability of a line pipe is evaluated as a critical strain rate at which crushing does not occur. Physical properties of a steel material, related to critical strain rate of a pipe, are a work hardening index and uniform elongation. For example, as the work hardening index and the uniform elongation are increased, deformability of the pipe is improved.

Uniform elongation of a steel material varies depending on the microstructure. A complex-phase structure is more advantageous in obtaining an improved uniform elongation than a single-phase structure.

A composition of a complex phase varies depending on strength. Generally, in a steel material having yield strength of 450 MPa or less, polygonal ferrite may be used as a main phase and a low-temperature transformation phase such as a small amount of bainite may be mixed to improve uniform elongation. In low-strength steel, such a composition of a phase causes a discontinuous yield behavior to be exhibited during a tensile test because fractions of a low-temperature transformation phase, having high potential density, and a second phase are significantly low. Meanwhile, when a fraction of a low-temperature transformation phase such as bainite or the like is increased, uniform elongation is decreased and toughness is also deteriorated.

As described above, since not only uniform elongation but also a mechanical property such as strength vary depending on a phase composition of complex structure steel, there is need for structure control capable of satisfying both strength or the like and uniform elongation.

DISCLOSURE

Technical Problem

An aspect of the present disclosure is to provide a steel material for a welded steel pipe, having excellent longitudinal uniform elongation for the pipe, in manufacturing a steel material for a line pipe, a method of manufacturing the steel material, and a steel pipe using the steel material.

Technical Solution

According to an aspect of the present disclosure, a steel material for a welded steel pipe, having excellent longitudinal uniform elongation, is provided. The steel material includes, by wt. %, carbon (C): 0.02 to 0.C7%, silicon (Si): 0.05 to 0.3%, manganese (Mn): 0.8 to 1.8%, aluminum (Al): 0.005 to 0.05%, nitrogen (N): 0.001 to 0.C1%, phosphorus (P): 0.020% or less, sulfur (S): 0.003% or less, nickel (Ni): 0.05 to 0.3%, chromium (Cr): 0.05 to 0.5%, niobium (Nb): 0.01 to 0.1%, and a balance of iron (Fe) and inevitable impurities, and 20 to 50% of polygonal ferrite by area fraction, a low-temperature transformation phase, and a second phase are included as a microstructure, the low-temperature transformation phase is acicular ferrite and bainite.

According to another aspect of the present disclosure, a welded steel pipe, having excellent longitudinal uniform elongation, obtained by pipe making and welding a steel material for a welded steel pipe, is provided.

According to another aspect of the present disclosure, a method of manufacturing a steel material for a welded steel pipe having excellent longitudinal uniform elongation is provided. The method includes reheating a steel slab satisfying the above-described alloy composition within a temperature range from 1100 to 1200° C.; terminating finishing rolling of the reheated steel slab within a temperature range from Ar3 to 900° C. to manufacture a hot-rolled steel plate; primarily cooling the hot-rolled steel plate to Bs or higher at a cooling rate of 2 to 15° C./s; secondarily cooling the hot-rolled steel plate to a temperature of 350 to 500° C. at a cooling rate of 20 to 50° C./s after the primarily cooling; and air-cooling the hot-rolled steel plate to a room temperature after the secondarily cooling.

Advantageous Effects

According to the present disclosure, in providing a steel material for a welded steel pipe having a thickness of 15 to 30 mm, a steel material for a welded steel pipe, having a longitudinal uniform elongation of 8% or more and yield strength of 600 MPa or less, may be provided.

Since such a steel material for a welded steel pipe of the present disclosure has excellent deformability, the steel material may be advantageously applied to a line pipe, required to have high deformability, or the like.

DESCRIPTION OF DRAWINGS

FIG. 1 is an image, obtained by observing microstructures of Inventive Examples 12 and 13 and Comparative Examples 6 and 12, in an example in the present disclosure.

BEST MODE FOR INVENTION

The present inventors have confirmed that deformability of a line pipe is related to uniform elongation of a steel material, and conducted intensive researches into a method of obtaining a steel material for a line pipe having excellent uniform elongation. As a result, the present inventors have confirmed that a microstructure, advantageous in securing excellent uniform elongation, may formed by optimizing an alloying composition and manufacturing conditions of a steel material to provide a steel material for a welded steel pipe having excellent longitudinal uniform elongation of the pipe, thereby implementing the present disclosure.

Hereinafter, the present disclosure will be described in detail.

According to an aspect of the present disclosure, a steel material for a welded steel pipe, having excellent longitudinal uniform elongation, includes, by weight % (wt %), C: 0.02 to 0.07%, Si: 0.05 to 0.3%, Mn: 0.8 to 1.8%, Al: 0.005 to 0.05%, N: 0.001 to 0.01%, P: 0.020% or less, S: 0.003% or less, Ni: 0.05 to 0.3%, Cr: 0.05 to 0.5%, and Nb: 0.01 to 0.1%.

Hereinafter, the reason why the alloy components of a steel material for a welded steel pipe, provided by the present disclosure, are limited as described above will be described in detail. A content of each component refers to wt % unless otherwise stated.

C: 0.02 to 0.07%

Carbon (C) is an element effective in strengthening steel through solid-solution strengthening and precipitation strengthening. However, when a content of C is excessive, an upper yield point is shown by dislocation pinning, caused by solid-solubilized C, during a coating heat treatment after pipe making, and thus, uniform elongation is decreased. Therefore, in the present disclosure, the content of C is controlled to be, in detail, 0.07% or less. However, when the content of C is less than 0.02%, a low-temperature transformation phase, formed to secure uniform elongation, may not be secured in a sufficient fraction.

Therefore, the content of C is controlled to be, in detail, 0.02 to 0.07%.

Si: 0.05 to 0.3%

Silicon (Si) is an element not only serving to deoxidize molten steel but also serving to improve strength of steel as a solid-solution strengthening element. Si is added in amount of, in detail, 0.05% or more to achieve the above effect. When the content of Si is greater than 0.3%, formation of a second phase such as cementite is significantly inhibited to decrease deformability in the case of a ferrite single phase.

Therefore, the content of Si is controlled to be, in detail, 0.05 to 0.3%.

Mn: 0.8 to 1.8%

Manganese (Mn) serves to a solid-solution strengthening element, and serves to improve strength of steel and to increase hardenability of the steel to promote formation of a low-temperature transformation phase. When the content of Mn is less than 0.8%, it may be difficult to secure target strength and a low-temperature transformation phase of an appropriate fraction for improving uniform elongation may not be formed. Meanwhile, when the content of Mn is greater than 1.8%, a polygonal ferrite phase for securing uniform elongation may not be sufficiently secured, center segregation is facilitated during slab casting, and weldability of the steel may be deteriorated.

Therefore, the content of Mn is controlled to be, in detail, 0.8 to 1.8.

Al: 0.005 to 0.05%

Similarly to Si, aluminum (Al) is an element serving to deoxidize molten steel. To this end, Al is added in an amount of, in detail, 0.005% or more. However, when the content of Al is greater than 0.05%, $Al_2O_3$, a nonmetal oxide, is formed to decrease toughness of a base material and a weld zone.

Therefore, the content of Al is controlled to be, in detail, 0.005 to 0.05%.

N: 0.001 to 0.01%

Nitrogen (N) forms a nitride together with Al to help strength improvement. However, when the content of N is greater than 0.01%, N is present in a solid-solubilized state, and N in the solid-solubilized state has an adverse influence on toughness of steel, it is not preferable.

Therefore, the content of N is controlled to be, in detail, 0.01% or less. Since it is difficult to industrially completely remove N from steel, a load thereof is controlled to a lower limit of 0.001 wt %, allowable in a manufacturing process.

P: 0.020% or Less

Phosphorus (P) is an element inevitably contained during steel manufacturing. When the content of P is excessively high, weldability of steel is decreased and P tends to be segregated in a center of a slab and austenite grain boundary to decrease toughness.

Therefore, the content of P needs to be decreased as low as possible. In the present disclosure, the content of P is controlled to be 0.020% or less in consideration of a load generated in a steelmaking process.

S: 0.003% or Less

Sulfur (S) is an element inevitably contained during steel manufacturing. In general, S reacts with copper (Cu) to form CuS, and thus, the amount of Cu, affecting a corrosion reaction, is decreased to deteriorate corrosion resistance. In addition, MnS is formed in a center region of the steel material to deteriorate low-temperature toughness, Therefore, the content of S needs to be decreased as low as possible. In the present disclosure, the content of S is controlled to be 0.003% or less in consideration of a process limitation for removal of S.

Ni: 0.05 to 0.3%

Nickel (Ni) is a solid-solubility strengthening element and is added to improve strength and toughness of steel. To achieve the above-mentioned effect, Ni is added in an amount of, in detail, 0.05% or more. However, since Ni is an expensive element causing rise in costs and excessive addition of Ni leads to a deterioration in weldability, the content of Ni is limited to, in detail, 0.3% or less.

Therefore, the content of Ni is controlled to be, in detail, 0.05 to 0.3%.

Cr: 0.05 to 0.5%

Chromium (Cr) is an element effective in securing hardenability during cooling and forming a second phase such as cementite and a low-temperature transformation phase. Cr reacts with C in steel to form a carbide, such that solid-solubilized C in ferrite is reduced to be effective in inhibiting strain aging during a coating heat treatment after pipe making.

To sufficiently achieve the above-mentioned effect, Cr is added in an amount of, in detail, 0.05% or more. However, when the content of Cr is greater than 0.5%, manufacturing costs may be increased to be economically disadvantageous.

Therefore, the content of Cr is controlled to be, in detail, 0.05 to 0.5%.

Nb: 0.01 to 0.1%

Niobium (Nb) reacts with C and N to be precipitated on a slab in the form of NbC or NbCN, The precipitates are dissolved in a reheating process, such that Nb may be solid-solubilized in the steel material to serve to delay recrystallization during rolling. Since the delay of recrystallization facilitates accumulation of deformation in austenite even when rolling is performed at a high temperature, and thus promotes nucleation of ferrite during ferrite transformation after the rolling to be effective in grain refinement. Solid-solubilized Nb is precipitated as fine Nb(C,N) during finishing rolling, serving to improve strength. Moreover, Nb precipitates C, solid-solubilized in ferrite, serving to inhibit a decrease in uniform elongation caused by strain aging.

To sufficiently achieve the above-mentioned effect, Nb is added in an amount of, in detail, 0.01% or more. However, when the content of Nb is greater than 0.1%, coarse precipitates are formed on a slab, and thus, Nb may not be sufficiently solid-solubilized during reheating. For this reason, Nb serves an initiation point of cracking to deteriorate low-temperature toughness.

Therefore, the content of Nb is controlled to be, in detail, 0.01 to 0.1%.

Although a steel material of the present disclosure satisfies the above-described alloying composition to secure intended physical properties, the steel material may further include at least one of Mo, Ti, Cu, V, and Ca to further improve the physical properties.

Mo: 0.05 to 0.3%

Molybdenum (Mo) is an element having significantly high hardenability and promotes formation of a low-temperature transformation phase even with a small amount of Mo when a hardenability element such as C or Mn is not sufficient. For example, when a matrix is a ferrite matrix, uniform elongation may be improve by increasing a fraction on bainite or martensite under the same manufacturing condition. In addition, Mo may react with C to form a carbide and may prevent the uniform elongation from being decreased by strain aging.

To achieve the above-mentioned effect, Mo is added in an amount of, in detail, 0.05% or more. However, Mo is an expensive element causing rise in costs and, when the content of Mo is greater than 0.3%, manufacturing costs may be increased to be economically disadvantageous.

Therefore, the content of Mo is controlled to be, in detail, 0.05 to 0.3%.

Ti: 0.005 to 0.02%

Since titanium (Ti) is present as a precipitate in a slab in the form of TiN or (Nb,Ti)CN, Ti serves to decrease the amount of solid-solubilized C in ferrite. Nb is dissolved to be solid-solubilized during a reheating process, while Ti is not dissolved during a reheating process and is present on an austenite grain boundary in the form of TiN. Since a TiN precipitate present in the austenite grain serves to inhibit austenite grain boundary growth which occurs during a reheating process, the TiN precipitate contribute to ultimate ferrite grain refinement.

As described above, to effectively inhibit the austenite grain growth, Ti is added in an amount of, in detail, 0.005% or more. However, when the content of Ti is excessive and greater than 0.02%, the amount of Ti is significantly greater than the amount of N in steel, and thus, a coarse precipitate is formed. Since the coarse precipitate does not contribute to inhibition of the austenite grain growth, the excessive content of Ti is not preferable.

Therefore, the content of the added Ti is controlled to be, in detail, 0.005 to 0.02%.

Cu: 0.3% or Less

Copper (Cu) is a solid-solubility strengthening element and serves to improve strength of steel. When the content of Cu is greater than 0.3%, surface cracking occurs during manufacturing of a slab to lower local corrosion resistance. In addition, when a slab for rolling is reheated, Cu having a low melting point penetrates a grain boundary of steel to cause cracking during hot working.

Therefore, the content of the added Cu is controlled to be, in detail, 0.3% or less.

V: 0.01 to 0.07%

Vanadium (V) is precipitated in a VN when N is sufficiently present in steel, but is generally precipitated in a ferrite region in the form of VC. VC decreases a eutectoid carbon concentration during transformation from austenite to ferrite and provides a nucleation site for formation of cementite. Accordingly, V decreases the amount of C solid-solubilized in ferrite and promotes distribution of fine cementite to improve uniform elongation.

To sufficiently achieve the above-mentioned effect, V is added in an amount of, in detail, 0.01% or more. However, when the content of V is greater than 0.07%, a coarse precipitate is formed to lower toughness.

Therefore, the content of the added V is controlled to be, in detail, 0.01 to 0.07%.

Ca: 0.0005 to 0.005%

Calcium (Ca) serves to spheroidize MnS inclusions. Ca reacts with S, added in steel, to form CaS, and thus, inhibits reaction of Mn with S to inhibit formation of elongated MnS during rolling and to improve low-temperature toughness.

To achieve the above-mentioned effect, Ca is added in amount of, in detail, 0.0005% or more. However, since Ca is an element which has high volatility and thus, has low yield, an upper limit of Ca is controlled to be, in detail, 0.005% in consideration of a load produced in a steel manufacturing process.

Therefore, the content of the added Ca is controlled to be, in detail, 0.0005 to 0.005%.

A residual component of the present disclosure is iron (Fe). However, in a manufacturing process of the related art, unintentional impurities may be mixed from a raw material or a surrounding environment, which may not be excluded. Since the impurities are apparent to those skilled in the manufacturing process of the related art, an entirety of contents thereof will not be specifically described in the present disclosure.

A steel material for a welded steel pipe of the present disclosure, satisfying the above-described alloying composition, includes, in detail, polygonal ferrite, a low-temperature transformation phase, and a second phase as a microstructure.

The polygonal ferrite is included in an area fraction of, in detail, 20 to 50%. When the area fraction is less than 20%, strength of steel is high but uniform elongation may lower uniform elongation. Meanwhile, when the area fraction is greater than 50%, the content of C in a ferrite structure is increased. Thus, dislocation is fixed to carbon atoms in the ferrite structure after a coating heat treatment following pipe making to lower uniform elongation.

The low-temperature transformation phase may include acicular ferrite and bainite. The bainite may include granular bainite, having a low content of C, and bainitic ferrite.

In the low-temperature transformation phase, the acicular ferrite is included in an area fraction of, in detail, 20 to 40%. When the area fraction is less than 20% or greater than 40%, uniform elongation is rapidly lowered after strain aging.

In addition to the polygonal ferrite and the low-temperature transformation phase, a second phase may be included. The second phase may be at least one of, in detail, martensite-austenite constituent (MA), degenerated pearlite (DP), and cementite.

The second phase is included in, in detail, a content of 5% or less. When the content of the second phase is greater than 5%, toughness of steel is decreased. In the present disclosure, the content of the second phase may be 0%.

A steel material of a welded steel pipe of the present disclosure, satisfying both the above-described alloying composition and the microstructure, may secure excellent longitudinal uniform elongation having uniform elongation of 8% or more while having yield strength of 600 MPa.

Hereinafter, according to another aspect of the present disclosure, a method of manufacturing a steel material for a welded steel pipe, having longitudinal uniform elongation, will be described in detail.

A steel plate for a welded steel pipe according to the present disclosure may be manufactured by performing "reheating-hot rolling-cooling" processes on a steel slab. Hereinafter, conditions of the respective processes will be described in detail.

Reheating of Steel Slab

A steel slab is, in detail, reheated before performing hot rolling. During the reheating, an NbCN precipitate is decomposed on the slab to sufficiently solid-solubilize Nb. The solid-solubilized Nb delays recrystallization during austenite rolling, such that deformation cumulation of an austenite phase is easily performed to promote grain refinement of an ultimate microstructure.

The reheating is performed at a temperature range, in detail, from 1100 to 1200° C. such that Nb is solid-solubilized in the slab in amount of 60% or more. When a heating temperature of the reheating is less than 1100° C., a solid-solubilized amount of Nb is decreased, and thus, strength improvement and a grain refinement effect may not be sufficiently obtained. Meanwhile, when a heating temperature of the reheating is high, Nb is easily solid-solubilized but grain growth of austenite occurs simultaneously. Therefore, a grain size of the ultimate microstructure is increased to improve hardenability and a low-temperature transformation phase is easily formed to make it difficult to form a complex structure of ferrite and the low-temperature transformation phase, and thus, uniform elongation is decreased. Therefore, an upper limit of the heating temperature of the reheating is limited to, in detail, 1200° C.

Hot Rolling

The reheated steel slab may be, in detail, hot-rolled to produce a hot-rolled steel plate. In detail, finishing rolling may be started at a temperature of 980° C. or less and is stopped within a temperature range from Ar3 to 900° C.

A finishing rolling starting temperature should be limited to accumulate rolling energy applied per pass during the finishing rolling by forming a deformation band or dislocation capable of acting as a nucleation site during ferrite transformation to austenite grains. In the present disclosure, the finishing rolling is start at a temperature of, in detail, 980° C. or less. When the finishing rolling is started at a temperature higher than 980° C., energy generated by rolling may be released without accumulation. Thus, the energy may not properly contribute to ferrite grain refinement.

After staring at the above-mentioned temperature, the finishing rolling is terminated within a temperature range, in detail, from Ar3 to 900° C.

As described above, the rolling energy, applied per pass during the finishing rolling, is accumulates by formation of a deformation band or dislocation in austenite grains, but dislocation extinction easily occurs at a high temperature. Thus, the rolling energy is easily lost without accumulation. As a result, in the case of the same reduction rate, energy, accumulated in the austenite grains, is not high when the finishing rolling is performed at a high temperature, and thus, ultimate ferrite grain refinement may not be sufficiently obtained.

Therefore, the finishing rolling is terminated at a temperature of, in detail, 900° C. or less in consideration of a limited alloying composition and a reduction ratio during the finishing rolling. However, when the finishing rolling stopping temperature is decreased below an Ar3 transformation point, ferrite and pearlite, formed by the transformation, may be deformed by rolling. Thus, polygonal ferrite for ensuring uniform elongation may not be formed, which makes it difficult to secure the uniform elongation.

Accordingly, the finishing rolling is terminated a temperature range, in detail, from Ar3 to 900° C. Ar3 may be expressed as:

$$Ar3=910-(310\times C)-(80\times Mn)-(20\times Cu)-(15\times Cr)-(55\times Ni)-(80\times Mo)+(0.35\times(T-8)),$$

where T represents a thickness of a steel material (mm), and each element refers to a weight content.

As described above, when the finishing rolling is performed by controlling the temperature, a total reduction ratio is, in detail, 60% or more.

Since recrystallization of the austenite rarely occurs during the finishing rolling following rough rolling, energy generates a deformation band or dislocation, capable of serving as a nucleation site during ferrite transformation, during rolling to decrease a size of an effective austenite grain. The greater the number of such ferrite nucleation sites, the finer ultimate ferrite grains. Therefore, it is advantageous in securing strength and uniform elongation.

To achieve the above-mentioned effect, a total reduction rate is controlled to be, in detail, 60% or more during the finishing rolling. When a reduction rate is insufficient during the finishing rolling, a fine grain may not be generated during ferrite transformation and an effective austenite grain may become coarse to increase hardenability, and thus, a bainite fraction may be excessively formed. In this case, the uniform elongation is decreased.

Cooling

A hot-rolled steel plate, produced through the above procedure, may be cooled to manufacture a steel material for a welded steel pipe having an intended microstructure.

In performing the cooling, the cooling is started at a temperature of, in detail, Ar3-20° C. or higher.

An ultimate microstructure of the steel material is determined by controlling the ferrite transformation in austenite after the finishing rolling. Microstructural factors, determining the uniform elongation, are a fraction of the second phase and a grain size except for the ferrite. Polygonal ferrite (air-cooled ferrite), formed during air cooling following the finishing rolling, has a large grain size, which is not only disadvantageous in securing strength, but also makes it difficult to secure uniform elongation. Accordingly, the cooling is started at a temperature of, in detail, Ar3-20° C. or higher in order to control the amount of polygonal ferrite formed during the cooling.

In this case, the cooling may be performed stepwise to secure an intended microstructure. In detail, the cooling may include primary cooling, performed to a bainite transformation starting temperature (Bs) or higher, and secondary cooling performed to a temperature range from 350 to 500° C.

More specifically, the primary cooling may be performed, in detail, at a cooling rate of 2 to 15° C./s at a temperature of the cooling starting temperature to Bs or higher.

A microstructure, in which fine ferrite and low-temperature transformation phases are mixed, should be formed to secure excellent uniform elongation. The strength and the uniform elongation vary depending on a ratio of each phase. As mentioned above, the air-cooled ferrite, formed during the air cooling, is disadvantageous in improving the strength or the uniform elongation due to a coarse grain. Therefore, fine ferrite may be formed by, in detail, a water-cooling process.

Accordingly, in detail, formation of bainite may be inhibited and fine ferrite may be formed in the primary cooling, and a low-temperature transformation phase may be formed in the secondary cooling following the primary cooling. Accordingly, the primary cooling may be performed up to, in detail, Bs or higher. Bs may be expressed as:

$$Bs=830-(270\times C)-(90\times Mn)-(37\times Ni)-(70\times Cr)-(83\times Mo).$$

The cooling is performed, in detail, at a cooling rate of 2 to 15° C./s to form polygonal ferrite without bainite transformation by deviating from a cooling nose during the cooling to Bs or higher. Since coarse ferrite is formed when the cooling rate is less than 2° C./s, the strength is decreased. Meanwhile, when the cooling rate is greater than 15° C./s, the amount of polygonal ferrite formed is small and fractions of low-temperature transformation phases is increased, which is not preferable.

After the primary cooling is completed, the secondary cooling may be performed, in detail, at a cooling rate of 20 to 50° C./s at a temperature of 350 to 500° C.

The secondary cooling may be performed, in detail, to a bainite transformation stopping temperature (Bf) or lower such that untransformed austenite during the primary cooling may be sufficiently transformed into a low-temperature transformation phase such as bainite. The bainite transformation stopping temperature is lower than a bainite transformation starting temperature by about 120° C., and may be limited to, in detail, 500° C. or lower in consideration of the alloying composition proposed in the present disclosure. However, when the cooling stopping temperature is significantly low, the amount of highly brittle martensite formed may be increased. Accordingly, the cooling may be terminated, in detail, at a martensitic transformation starting temperature (Ms) or higher to prevent transformation of a martensite phase. In the present disclosure, the cooling stopping temperature may be limited to, in detail, 350° C. or higher.

When the cooling is performed in a temperature range from 350 to 500° C., a cooling rate thereof may be higher than a cooling rate of the primary cooling such that a phase of austenite, untransformed into ferrite during the primary cooling, may be transformed into a low-temperature transformation phase such as a bainite phase. Therefore, the cooling rate may be controlled to be, in detail, 20 to 50° C./s.

As described above, after first water cooling and second water cooling are completed, air cooling may be performed to a room temperature.

A welded steel pipe may be manufactured using a steel material for a welded steel pipe manufactured through the above-described procedure. As an example, a welded steel pipe may be obtained by pipe making and welding a manufactured steel material for a welded steel pipe. A welding method for obtaining the welded steel pipe is not limited. As an example, submerged arc welding may be used.

In addition, a coating heat treatment may be performed on the welded steel pipe under usual conditions.

In the description below, an example embodiment of the present disclosure will be described in greater detail. It should be noted that the exemplary embodiments are provided to describe the present disclosure in greater detail, and to not limit the scope of rights of the present disclosure. The scope of rights of the present disclosure may be determined on the basis of the subject matters recited in the claims and the matters reasonably inferred from the subject matters.

MODE FOR INVENTION

Steel slabs, having alloying compositions listed in Table 1, were prepared and then subjected to reheating-finishing rolling-cooling processes under conditions, listed in Table 2, to manufacture steel materials.

By observing microstructures of the respective steel materials and preparing tensile samples in longitudinal directions of the steel materials, tensile tests were conducted to evaluate strength and uniform elongation.

For the microstructures, fractions of polygonal ferrite and acicular ferrite were measured after etching the samples of the respective steel materials. Results thereof are listed in Table 3, and results of the above tensile tests are also listed in Table 3.

TABLE 1

| Steel | Alloying composition (wt %) | | | | | | | | | | | | | | |
|---|---|---|---|---|---|---|---|---|---|---|---|---|---|---|---|
| Type | C | Si | Mn | P | S | Al | Ni | Cr | Nb | N | Ti | Cu | Mo | V | Ca |
| 1 | 0.032 | 0.25 | 1.35 | 0.012 | 0.0009 | 0.025 | 0.2 | 0.2 | 0.045 | 0.0040 | 0 | 0 | 0 | 0 | 0 |
| 2 | 0.045 | 0.25 | 1.60 | 0.008 | 0.0012 | 0.020 | 0.1 | 0.15 | 0.03 | 0.0039 | 0 | 0 | 0 | 0 | 0 |
| 3 | 0.061 | 0.15 | 1.20 | 0.020 | 0.0022 | 0.035 | 0.15 | 0.25 | 0.03 | 0.0042 | 0 | 0 | 0 | 0 | 0 |
| 4 | 0.050 | 0.20 | 1.65 | 0.015 | 0.0015 | 0.021 | 0.1 | 0.1 | 0.045 | 0.0048 | 0.011 | 0 | 0 | 0 | 0 |
| 5 | 0.059 | 0.25 | 1.70 | 0.009 | 0.0012 | 0.026 | 0.2 | 0.25 | 0.04 | 0.0043 | 0 | 0 | 0.1 | 0 | 0 |
| 6 | 0.070 | 0.15 | 1.40 | 0.012 | 0.0008 | 0.030 | 0.1 | 0.2 | 0.038 | 0.0049 | 0.012 | 0.1 | 0 | 0.03 | 0 |
| 7 | 0.050 | 0.25 | 1.50 | 0.010 | 0.0013 | 0.027 | 0.15 | 0.15 | 0.03 | 0.0048 | 0 | 0 | 0.1 | 0.01 | 0.0010 |
| 8 | 0.041 | 0.25 | 1.20 | 0.006 | 0.0007 | 0.025 | 0.1 | 0.3 | 0.045 | 0.0041 | 0 | 0.15 | 0 | 0 | 0.0012 |
| 9 | 0.055 | 0.20 | 1.45 | 0.014 | 0.0013 | 0.026 | 0.1 | 0.2 | 0.02 | 0.0052 | 0.01 | 0 | 0.15 | 0 | 0.0015 |
| 10 | 0.035 | 0.45 | 1.50 | 0.025 | 0.0024 | 0.035 | 0.2 | 0.25 | 0.02 | 0.0042 | 0 | 0.2 | 0 | 0 | 0 |
| 11 | 0.080 | 0.20 | 1.15 | 0.018 | 0.0012 | 0.035 | 0.15 | 0.25 | 0.03 | 0.0130 | 0 | 0 | 0 | 0 | 0 |
| 12 | 0.035 | 0.10 | 1.55 | 0.013 | 0.0011 | 0.034 | 0.05 | 0.55 | 0.014 | 0.0052 | 0 | 0 | 0.1 | 0 | 0 |
| 13 | 0.030 | 0.10 | 1.90 | 0.018 | 0.000 | 0.018 | 0.1 | 0.3 | 0.04 | 0.0043 | 0 | 0.1 | 0 | 0 | 0.0012 |
| 14 | 0.050 | 0.25 | 1.60 | 0.012 | 0.0010 | 0.026 | 0.2 | 0.2 | 0 | 0.0047 | 0 | 0 | 0.15 | 0 | 0.0010 |
| 15 | 0.070 | 0.15 | 1.45 | 0.009 | 0.0008 | 0.023 | 0.3 | 0 | 0.045 | 0.0049 | 0.01 | 0 | 0 | 0 | 0.0010 |
| 16 | 0.055 | 0.25 | 1.55 | 0.010 | 0.0014 | 0.034 | 0 | 0.3 | 0.04 | 0.0042 | 0 | 0 | 0.1 | 0 | 0 |

TABLE 2

| | | Finishing Rolling | | | First Cooling | | | Secondary cooling | | | | |
|---|---|---|---|---|---|---|---|---|---|---|---|---|
| Steel Type | Reheating Temperature (° C.) | Reduction Ratio (%) | Starting Temperature (° C.) | Stopping temperature (° C.) | Starting Temperature (° C.) | Stopping Temperature (° C.) | Cooling Rate (° C./s) | Stopping Temperature (° C.) | Cooling Rate (° C./s) | Ar3 (° C.) | Bs (° C.) | Classi-fication |
| 1 | 1160 | 70 | 970 | 890 | 800 | 700 | 3 | 450 | 20 | 784.3 | 678.5 | IE1 |
| 1 | 1160 | 70 | 950 | 870 | 780 | 700 | 7 | 400 | 25 | 784.3 | 678.5 | IE2 |
| 1 | 1160 | 75 | 950 | 830 | 770 | 690 | 5 | 450 | 25 | 784.3 | 678.5 | IE3 |
| 2 | 1180 | 75 | 950 | 850 | 780 | 720 | 5 | 450 | 28 | 766.7 | 659.7 | IE4 |
| 2 | 1120 | 75 | 950 | 850 | 780 | 700 | 8 | 450 | 24 | 766.7 | 659.7 | IE5 |
| 3 | 1120 | 60 | 930 | 860 | 800 | 700 | 10 | 500 | 25 | 789.6 | 682.5 | IE6 |
| 3 | 1120 | 65 | 930 | 850 | 790 | 700 | 8 | 480 | 25 | 789.6 | 682.5 | IE7 |
| 3 | 1120 | 70 | 930 | 830 | 770 | 700 | 5 | 480 | 25 | 789.6 | 682.5 | IE8 |
| 4 | 1140 | 75 | 950 | 870 | 820 | 720 | 10 | 450 | 28 | 761.9 | 657.3 | IE9 |
| 4 | 1140 | 75 | 950 | 870 | 820 | 710 | 8 | 420 | 33 | 761.9 | 657.3 | IE10 |
| 4 | 1140 | 70 | 950 | 880 | 840 | 740 | 10 | 380 | 40 | 761.9 | 657.3 | IE11 |
| 5 | 1120 | 75 | 930 | 820 | 750 | 670 | 8 | 450 | 20 | 739.4 | 627.9 | IE12 |
| 5 | 1120 | 75 | 950 | 850 | 780 | 700 | 8 | 500 | 25 | 739.4 | 627.9 | IE13 |
| 6 | 1180 | 80 | 980 | 880 | 830 | 700 | 12 | 400 | 23 | 772.4 | 667.4 | IE14 |
| 6 | 1180 | 75 | 950 | 850 | 800 | 680 | 15 | 400 | 20 | 772.4 | 667.4 | IE15 |
| 6 | 1140 | 75 | 900 | 800 | 760 | 680 | 8 | 350 | 25 | 772.4 | 667.4 | IE16 |
| 7 | 1120 | 70 | 960 | 860 | 790 | 700 | 10 | 400 | 23 | 762.4 | 657.2 | IE17 |
| 7 | 1120 | 70 | 960 | 840 | 770 | 690 | 10 | 400 | 23 | 762.4 | 657.2 | IE18 |
| 8 | 1100 | 75 | 960 | 830 | 780 | 690 | 15 | 400 | 23 | 794.6 | 686.2 | IE19 |
| 8 | 1100 | 75 | 950 | 820 | 780 | 690 | 10 | 450 | 25 | 794.6 | 686.2 | IE20 |
| 8 | 1100 | 70 | 950 | 840 | 790 | 700 | 13 | 450 | 25 | 794.6 | 686.2 | IE21 |
| 9 | 1140 | 65 | 970 | 890 | 830 | 720 | 15 | 480 | 28 | 762.9 | 654.5 | IE22 |
| 9 | 1140 | 65 | 940 | 860 | 810 | 700 | 13 | 480 | 23 | 762.9 | 654.5 | IE23 |
| 1 | 1050 | 60 | 900 | 810 | 770 | 600 | 4 | 500 | 20 | 784.3 | 678.5 | CE1 |
| 1 | 1100 | 65 | 890 | 750 | 720 | 550 | 3 | 500 | 15 | 784.3 | 678.5 | CE2 |
| 10 | 1160 | 70 | 950 | 870 | 780 | 750 | 7 | 400 | 50 | 766.7 | 660.7 | CE3 |
| 2 | 1180 | 80 | 1020 | 880 | 800 | 750 | 20 | 300 | 10 | 766.7 | 659.7 | CE4 |
| 11 | 1180 | 75 | 950 | 850 | 780 | 750 | 5 | 450 | 28 | 787.9 | 681.9 | CE5 |
| 3 | 1140 | 75 | 920 | 820 | 760 | 600 | 8 | 550 | 15 | 789.6 | 682.5 | CE6 |
| 12 | 1120 | 70 | 930 | 830 | 770 | 580 | 5 | 480 | 25 | 762.4 | 632.5 | CE7 |
| 4 | 1140 | 50 | 890 | 840 | 790 | 550 | 8 | 400 | 25 | 761.9 | 657.3 | CE8 |
| 13 | 1140 | 75 | 950 | 870 | 820 | 750 | 8 | 420 | 33 | 742.9 | 626.2 | CE9 |
| 5 | 1120 | 75 | 880 | 780 | 700 | 600 | 10 | 350 | 25 | 739.4 | 627.9 | CE10 |
| 14 | 1120 | 75 | 950 | 850 | 780 | — | — | 500 | 25 | 746.9 | 638.7 | CE11 |
| 14 | 1120 | 75 | 930 | 820 | 750 | — | — | 450 | 20 | 746.9 | 638.7 | CE12 |
| 6 | 1220 | 80 | 980 | 840 | 790 | 740 | 10 | 500 | 18 | 772.4 | 667.4 | CE13 |
| 15 | 1180 | 80 | 980 | 880 | 830 | 750 | 12 | 400 | 23 | 762.4 | 669.5 | CE14 |
| 7 | 1160 | 80 | 1020 | 930 | 870 | 680 | 25 | 350 | 15 | 762.4 | 657.2 | CE15 |
| 16 | 1120 | 70 | 960 | 840 | 770 | 690 | 25 | 400 | 10 | 762.9 | 646.4 | CE16 |

IE: Inventive Example/CE: Comparative Example (In Table 2, Comparative Examples 11 and 12 are a case in which single cooling was performed under secondary cooling conditions after finishing rolling.)

TABLE 3

| | Microstructure (Fraction %) | | Mechanical Property | | |
|---|---|---|---|---|---|
| Classification | Polygonal Ferrite | Acicular Ferrite | Longitudinal Yield Strength (MPa) | Longitudinal Tensile Strength (MPa) | Longitudinal Uniform Elongation (%) |
| IE 1 | 35 | 40 | 465 | 535 | 12 |
| IE 2 | 30 | 40 | 461 | 540 | 13 |
| IE 3 | 39 | 30 | 450 | 545 | 14 |
| IE 4 | 25 | 40 | 498 | 583 | 12 |
| IE 5 | 30 | 35 | 460 | 537 | 13 |
| IE 6 | 35 | 25 | 457 | 535 | 13 |
| IE 7 | 37 | 25 | 455 | 550 | 14 |
| IE 8 | 30 | 30 | 467 | 554 | 13 |
| IE 9 | 22 | 35 | 503 | 597 | 11 |
| IE 10 | 25 | 40 | 511 | 598 | 10 |
| IE 11 | 20 | 25 | 518 | 605 | 10 |
| IE 12 | 45 | 20 | 449 | 525 | 14 |
| IE 13 | 30 | 25 | 461 | 545 | 14 |
| IE 14 | 27 | 25 | 498 | 590 | 12 |
| IE 15 | 32 | 25 | 475 | 560 | 13 |
| IE 16 | 36 | 20 | 470 | 560 | 13 |
| IE 17 | 25 | 35 | 504 | 589 | 11 |
| IE 18 | 30 | 35 | 485 | 584 | 10 |
| IE 19 | 28 | 35 | 495 | 591 | 11 |
| IE 20 | 32 | 25 | 475 | 580 | 12 |
| IE 21 | 32 | 25 | 474 | 584 | 12 |
| IE 22 | 20 | 40 | 520 | 617 | 10 |
| IE 23 | 25 | 40 | 507 | 595 | 11 |
| CE 1 | 65 | 10 | 421 | 465 | 7 |
| CE 2 | 70 | 5 | 415 | 457 | 7 |
| CE 3 | 15 | 10 | 537 | 608 | 5 |
| CE 4 | 5 | 10 | 560 | 648 | 5 |
| CE 5 | 10 | 5 | 554 | 634 | 5 |
| CE 6 | 60 | 5 | 426 | 460 | 7 |
| CE 7 | 60 | 10 | 430 | 475 | 7 |
| CE 8 | 70 | 15 | 410 | 461 | 7 |
| CE 9 | 1 | 10 | 605 | 695 | 5 |
| CE 10 | 55 | 15 | 440 | 494 | 7 |
| CE 11 | 2 | 70 | 535 | 611 | 7 |
| CE 12 | 5 | 70 | 530 | 615 | 7 |
| CE 13 | 5 | 15 | 530 | 603 | 7 |
| CE 14 | 7 | 15 | 527 | 607 | 6 |
| CE 15 | 2 | 15 | 554 | 638 | 6 |
| CE 16 | 5 | 15 | 550 | 640 | 6 |

IE: Inventive Example/
CE: Comparative Example (In Inventive Examples 1 to 23 of Table 3, except for polygonal ferrite and acicular ferrite, the others are a bainite phase and a second phase, and the content of the second phase is less than 5%. In structural fractions of Comparative Examples 1 to 16, the others are also a bainite phase and a second phase.)

As can be seen from Tables 1 and 2, steels 1 to 9 satisfy the alloying composition proposed in the present disclosure, and Inventive Examples 1 to 23, using steels 1 to 9, satisfy the present disclosure. Meanwhile, Comparative Examples 1 to 16 are cases in which steel, having an alloying composition which is outside of the present disclosure, is used or in which manufacturing conditions do not satisfy conditions proposed in the present disclosure.

As can be seen from Table 3, Inventive Examples 1 to 23 have excellent uniform elongation of 8% or more because a polygonal ferrite phase and a low-temperature transformation phase were appropriately formed in the steel.

Meanwhile, Comparative Examples 1 to 16 have poor uniform elongation less than 8%.

FIG. 1 is an image, obtained by observing microstructures of Inventive Examples 12 and 13 and Comparative Examples 6 and 12. In the case of Inventive Examples 12 and 13, polygonal ferrite and low-temperature transformation phases such as bainite ferrite, and the like are variously formed. Meanwhile, an acicular ferrite phase is mainly formed in Comparative Example 12, and a polygonal ferrite phase is mainly formed in Comparative Example 6.

The invention claimed is:

1. A steel material for a welded steel pipe, the steel material comprising, by wt %, carbon (C): 0.02 to 0.07%, silicon (Si): 0.05 to 0.3%, manganese (Mn): 0.8 to 1.8%, aluminum (Al): 0.005 to 0.05%, nitrogen (N): 0.001 to 0.01%, phosphorus (P): 0.020% or less, sulfur (S): 0.003% or less, nickel (Ni): 0.05 to 0.3%, chromium (Cr): 0.05 to 0.5%, niobium (Nb): 0.01 to 0.1%, and a balance of iron (Fe) and inevitable impurities, wherein 20 to 50% of polygonal ferrite by area fraction, a low-temperature transformation phase, and a second phase are included as a microstructure, and the low-temperature transformation phase is acicular ferrite and bainite, wherein the acicular ferrite is included in an amount of 20 to 40% by area fraction, and wherein 5% or less, including 0%, of the second phase is included by area fraction.

2. The steel material of claim 1, further comprising at least one selected from the group consisting of, by wt %, molybdenum (Mo): 0.05 to 0.3%, titanium (Ti): 0.005 to 0.02%, copper (Cu): 0.3% or less, vanadium (V): 0.01 to 0.07%, and calcium (Ca): 0.0005 to 0.005%.

3. The steel material of claim 1, wherein the second phase is at least one of martensite-austenite constituent, degenerated pearlite, and cementite.

4. The steel material of claim 1, wherein the steel material has uniform elongation of 8% or more and yield strength of 600 MPa or less.

5. A welded steel pipe, having excellent longitudinal uniform elongation, obtained by pipe making and welding a steel material for a welded steel pipe of claim 1.

6. The steel material of claim 1, the steel material comprising, by wt %, manganese (Mn): 0.8 to 1.35%.

* * * * *